United States Patent [19]

Scherer

[11] 4,262,438

[45] Apr. 21, 1981

[54] STREET SIGN ASSEMBLY

[75] Inventor: John J. Scherer, New Auburn, Wis.

[73] Assignee: Safe Lite, Inc., Menomonee Falls, Wis.

[21] Appl. No.: 956,560

[22] Filed: Nov. 1, 1978

[51] Int. Cl.[3] ..... G09F 15/00

[52] U.S. Cl. ..... 40/607

[58] Field of Search ..... 40/584, 606, 10, 607

[56] References Cited

U.S. PATENT DOCUMENTS

| | | | |
|---|---|---|---|
| 1,802,939 | 4/1931 | Butler | 40/607 |
| 1,826,581 | 10/1931 | Sprung | 40/607 |
| 1,835,980 | 12/1931 | Hallowell | 40/607 X |
| 1,845,967 | 2/1932 | Fox | 40/607 |
| 2,188,437 | 1/1940 | Joyce | 40/607 |
| 2,849,816 | 9/1958 | Locke | 40/607 |
| 3,750,314 | 8/1973 | Crawford | 40/606 |
| 3,935,655 | 2/1976 | Frizinger | 40/607 |

*Primary Examiner*—Gene Mancene
*Assistant Examiner*—Wenceslao J. Contreras
*Attorney, Agent, or Firm*—Quarles & Brady

[57] ABSTRACT

An assembly for mounting and supporting street signs includes a cap structure adapted to be fastened to the top of a post and to secure a lower sign in place, and a two-piece upper sign holder for mounting an upper sign crosswise to the lower sign. The cap structure includes an integral clamping jaw extending from its base which cooperates with a second clamping jaw to secure the lower sign to the post. Attached to the upper edge margin of the lower sign is the two-piece sign holder. Each piece of the sign holder is identical and has an upper clamping jaw disposed crosswise to a lower clamping jaw such that when both pieces are clamped together the lower sign is secured between the lower clamping jaws at the same time the upper sign is secured between the upper clamping jaws.

14 Claims, 4 Drawing Figures

Fig. 7
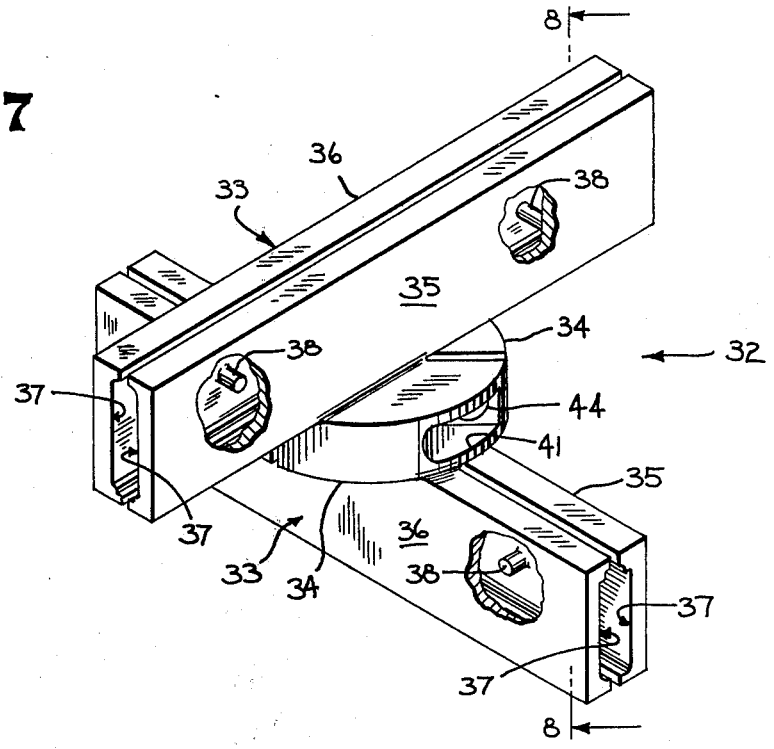
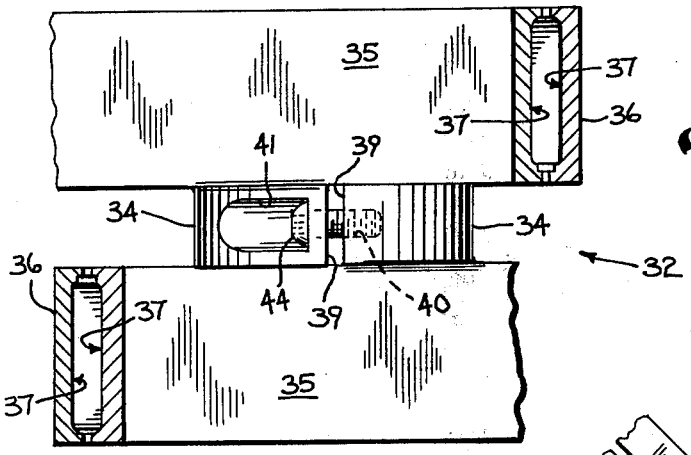
Fig. 8
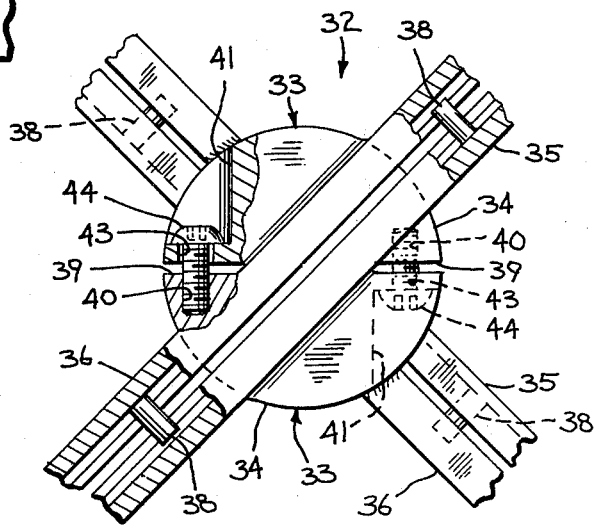
Fig. 9

STREET SIGN ASSEMBLY

BACKGROUND OF THE INVENTION

This invention relates to an assembly for displaying signs, and more particularly, to a support structure for securing conventional elongate street signs to the top of a vertical post.

Street signs are subjected to various forms of abuse so that it is desirable to have sturdy supports for such signs. One type of abuse is the destructive acts of juveniles that climb upon street signs and hang from or attempt to twist or otherwise mutilate them. Street signs are also subjected to intentional vandalism. Vandals break the signs loose from their support structures and carry them away. Another abuse arises from street signs being struck by moving vehicles. Support posts are frequently bent or broken off, and signs atop the posts can also be bent or damaged. Still another abuse arises because of varying weather conditions. Since street signs are used almost exclusively outdoors, they are exposed to weather conditions such as repeatedly strong winds. Varying weather conditions make it essential that the support structure for these signs be capable of resisting natural forces. Thus, it is desirable to provide a support structure for street signs that not only is strong and sturdy, but also is one that will aid in the prevention of vandalism.

Street signs are also manufactured in different degrees of thicknesses. For example, some signs may be manufactured with an overall uniform thickness, while others may have thickened edges at their side margins. Thus, it is also desirable to have a sign supporting structure that will readily adapt to and tightly secure signs of differing configurations and designs. Furthermore, it is desirable that a sign assembly be designed to provide easy assembly and disassembly in order to repair or replace the signs.

The prior art has provided a number of street sign assemblies that attempt to solve the above problems. In some of these arrangements, such as U.S. Pat. No. 3,750,314 issued to Crawford on Aug. 7, 1973, for "Sign Holder and Assembly," a support structure is disclosed having one-piece channel shaped members with set screws holding signs in the channelways. This structure, however, is not tamper-proof, and cannot accommodate street signs having side margins of varying dimensions. Another approach is disclosed in U.S. Pat. No. 1,826,581 issued to Sprung on Oct. 6, 1931, for "Street Sign." This patent discloses a two-piece cap secured to the top of a post having an integral frame for a lower street sign. There is also included a plug depending from a second frame for an upper street sign that is clamped to the lower frame. As with Crawford, this type of structure may easily be vandalized, and does not provide a means for mounting signs having side margins of differing configurations. U.S. Pat. No. 3,935,655 issued to Fritzinger on Feb. 3, 1976, for "Vandal-Proof Street Name Sign" demonstrates the concern with vandalism that has developed in the industry. An arm connected to a street sign assembly is anchored within a support post to reinforce the assembly and prevent unauthorized removal of the signs. However, a person may still remove the sign assembly if sufficient lifting force is exerted on the signs from above. Thus, none of the above arrangements have been entirely satisfactory, and the invention herein has been developed to provide not only an improved street sign support assembly, but also an improved vandal-proof support assembly.

SUMMARY OF THE INVENTION

The present invention relates to a support structure for mounting signs which includes a cap having a base adapted to be fastened to the top of a post, an integral clamping jaw extending from the base and disposed in opposing relation with a second clamping jaw to receive and hold a first sign therebetween, and an upper sign holder having complementary clamp members each with an upper clamping jaw disposed crosswise to a lower clamping jaw. The clamp members are adapted to be brought in close juxtaposition with one another to hold a second sign crosswise to the first sign.

Street signs are normally produced from elongate, flat metal plates of varying thicknesses at their side margins. These signs must then be mounted by a support structure on top of a post to display the names of streets at street intersections. Thus, the support structure for these signs must be sturdy enough to resist external forces acting on the signs, and must accommodate signs of varying thicknesses. Weather conditions such as repeated high winds, or attempts by persons to pull down and vandalize the signs may cause individual signs to be torn loose, or the entire support structure may be ripped from the post. In its preferred form, the present invention seeks to solve these problems by providing a support structure which has a two-piece cap adapted to tightly fasten around the top of a post and to secure a lower sign in place and a two-piece upper sign holder that mounts an upper sign crosswise to the lower sign. Each piece of the cap is identical and has a clamping jaw extending from its top which is used to secure the lower sign at the same time both cap pieces are tightened around the post. The two-piece upper sign holder is attached to the upper edge margin of the lower sign, and each piece of the sign holder is identical and has an upper clamping jaw disposed crosswise to a lower clamping jaw. When both pieces of the upper sign holder are clamped together, the lower sign is secured between the lower clamping jaws at the same time the upper sign is secured between the upper clamping jaws.

The clamping jaws of the cap and upper sign holder are preferably identical. Identical clampings jaws are provided for the support structure so that its construction may be simple and uncomplicated. Assembly of the preferred structure may then be accomplished simply by using a plurality of identical clamping jaws, and a pair of identical cap pieces.

It is an object of the invention to provde a sturdy support structure for street signs that cannot easily be destroyed or damaged.

It is another object of the invention to provide a support structure for street signs that will readily adapt to and secure signs of different configurations and designs.

It is another object of the invention to provide a support structure for street signs that has interchangeable elements so that a minimum number of parts are used in the assembly.

It is another object of the invention to provide a support structure for street signs that may easily be disassembled, repaired, and reassembled by a street repair crew at the site of installation.

It is still another object of the invention to provide a support structure for street signs that will readily display the street signs in any angular relationship.

BRIEF DESCRIPTION OF THE DRAWINGS

FIG. 7 is a view in perspective with parts cut away illustrating an alternative two-piece clamp constituting a second embodiment of the invention;

FIG. 8 is a fragmentary side view in section taken through the plane of the line 8—8 indicated in FIG. 7;

FIG. 9 is a fragmentary top view with parts cut away of the two-piece clamp of FIG. 7;

DESCRIPTION OF THE PREFERRED EMBODIMENT

Figure 1:
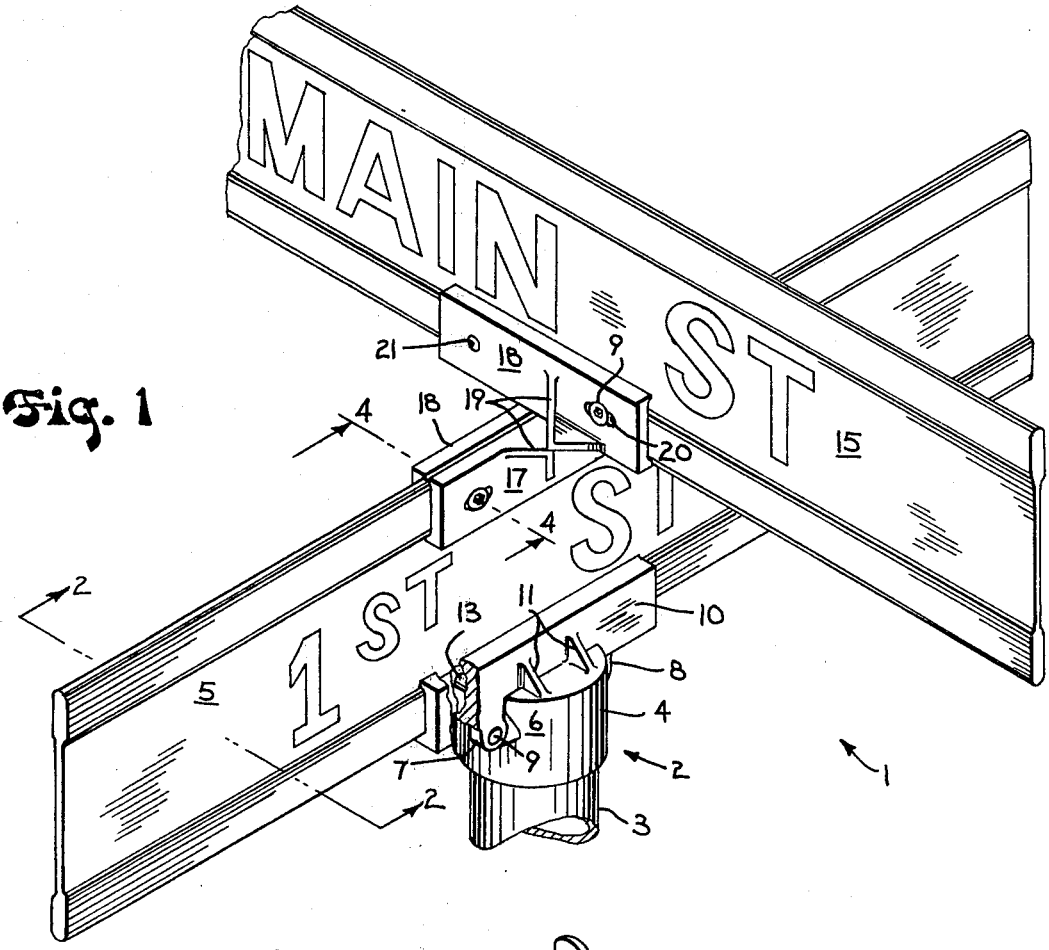
FIG. 1 is a view in perspective with parts cut away showing a street sign support structure constituting a first embodiment of the present invention.
Figure 2:
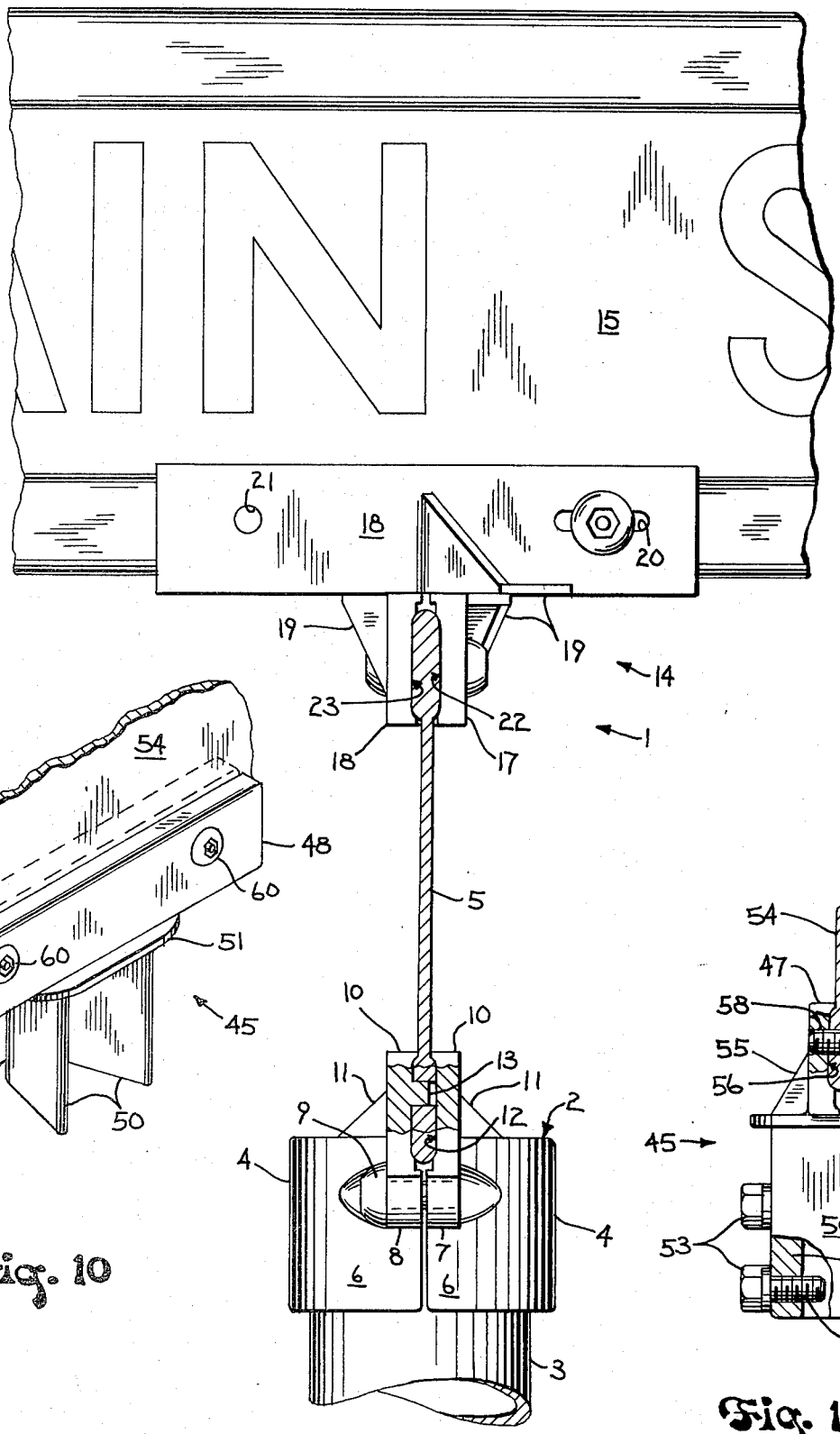
FIG. 2 is a fragmentary side view in elevation taken through the plane of the line 2—2 indicated in FIG. 1.

Referring to FIGS. 1 and 2, there is shown a street sign support structure, designated generally by the numeral 1, constituting a first embodiment of the invention. The support structure 1 includes a cap 2 fastened to the top of a cylindrically shaped vertical mounting post 3. The cap 2 comprises a pair of identical bases or cap sectors 4 that mount and support a lower sign 5. Each cap sector 4 fits over and around one-half of the top of the mounting post 3, and the sectors 4 face one another in a complementary or matching fashion. Each cap sector 4 has a semi-cylindrical body portion 6 enclosed at its top that circumferentially surrounds a corresponding half of the upper end of the post 3, so that the two body portions 6 form a hollow cylindrical shell or collar that closely conforms about the post 3. Each body portion 6 has a pair of integrally formed ear-like lugs 7 and 8 that project radially outward from its opposite ends, so that when the two cap sectors 4 are placed in facing relation to one another, as shown in FIGS. 1 and 2, the lug 7 of one body portion 6 faces the lug 8 of the other body portion 6. Each lug 8 has an opening to loosely receive the shaft of a fastening bolt 9, and each lug 7 has a threaded opening for engagement with its respective bolt 9. The bolts 9 may thus be inserted through the lugs 8 and engaged in the lug 7 so that they can be brought up tightly to firmly secure the cap 2 in place at the top of the mounting post 3.

The cap sectors 4 each include as an integral part thereof an elongate rail-shaped clamping jaw 10. The two clamping jaws 10 of the sectors 4 oppose one another in close juxtaposition for receiving and holding the lower margin of the sign 5 at a position medial of the sign length. Each clamping jaw 10 lies in the same plane as the lugs 7 and 8 of the cap sector 4 of which it is a part, and, as shown in FIG. 1, each clamping jaw 10 melds into the associated lugs 7, 8 to have a unitary construction. Each clamping jaw 10 overhangs beyond the body portion 6 of its cap sector 4, and rises vertically above the top of the body portion 6. Triangular shaped braces 11 on the top of each body portion 6 reinforce the jaws 10 and lend added strength and rigidity to the structure, so that the cap 2 can withstand substantial abusive forces without deformation. The clamping jaws 10 are formed with like, inwardly directed congruently disposed gripping faces 12 that oppose one another and mate with the contours of the sign 5. Each face includes at least one projecting pin 13 that enters a complementary opening in the sign 5 to hold the sign 5 from shifting its position, or from becoming dislodged if an improper attempt is made to remove it by force.

Figure 3:
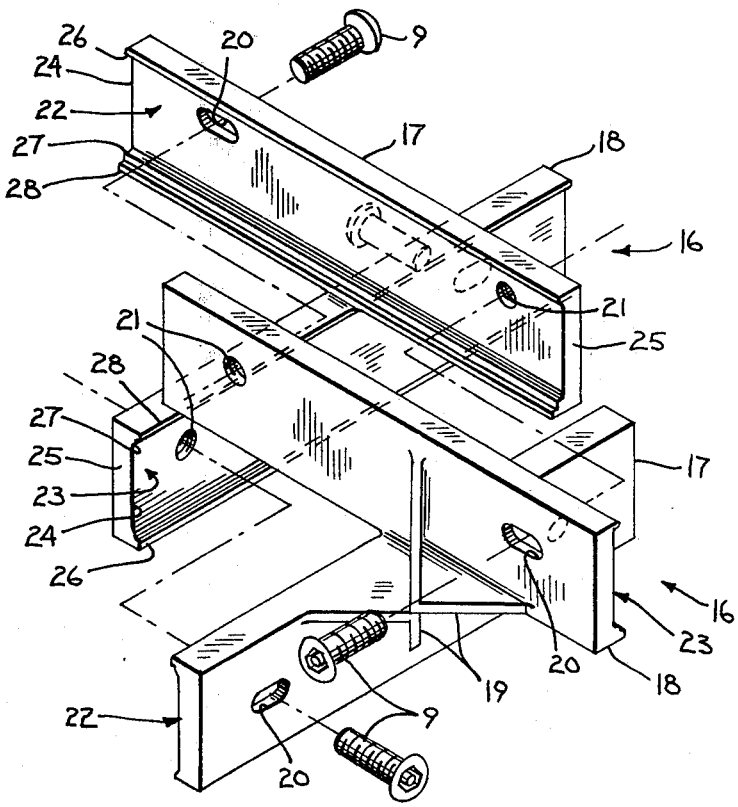
FIG. 3 is an exploded view in perspective illustrating the assemblage of a two-piece clamp forming a part of the support structure of FIG. 1.

As seen in FIGS. 1 and 2, there is an upper sign holder 14 directly above the cap 2 that is fastened to the top margin of the lower sign 5 medially of its ends. The sign holder 14 clamps about the lower edge margin of an upper sign 15 at its medial center, and it supports the sign 15 in a position crosswise to the lower sign 5. This sign holder 14 is comprised of two identical clamp members 16 which are shown spaced from one another in the exploded view of FIG. 3. In this view, the clamp members 16 are reversed top to bottom with respect to one another, and then rotated 90° about a vertical axis with respect to one another to bring them into complementary mating positions, such as they assume when clamping about the margins of the signs 5,15. Each clamp member 16 is made up of a first elongated clamping jaw 17 and a second elongated clamping jaw 18 that is attached to and disposed at right angles to the first jaw 17. An edge of one jaw 17,18 bears against the edge of the other jaw 17,18 and to secure the jaws 17,18 of each clamp member 16 together, a pair of angularly bent braces 19 are provided. The braces 19 and the clamping jaws 17,18 are preferably cast as one piece, as shown in FIGS. 1–3, to develop the unitary, rigid clamp members 16.

Each clamping jaw 17,18 has a slot 20 toward one end and a threaded opening 21 towards its opposite end. When the two clamp members 16 are brought into close juxtaposition with one another, so as to assume the positions shown in FIGS. 1 and 2, with each clamping jaw 17 in closely opposing relation with a clamping jaw 18, each slot 20 is then in alignment with a threaded opening 21. Additional fastening bolts 9 can then each pass through a slot 20 and a complementary opening in a respective sign 5,15 for threaded reception in an opening 21. The bolts 9 are brought up tightly so as to have the sign holder 14 clamping upon the upper margin of the lower sign 5 and also about the lower margin of the upper sign 15. In the particular embodiment shown in FIGS. 1–3, the clamping jaws 17,18 are at a 90° relationship which accommodates conventional street intersections, but it is to be understood that they may also be secured at different angular relationships for use at oblique street intersections, or in other installations where it is desired to mount a pair of signs crosswise to one another at some particular angle.

The four clamping jaws 17,18 of the upper sign holder 14 and the two clamping jaws 10 of the cap 2 are all of similar configuration. They may all be of identical length and of identical height. More particularly, the clamping jaws 17 and 18 have gripping faces 22 and 23, respectively, along one vertical side of each that are identical to one another and also to the gripping faces 12 of the clamping jaws 10 of the cap 2. As particularly seen in FIG. 3, each of these faces 12,22,23 has a dished or recessed groove 24 with a central flat area extending for the length of the clamping jaw between the upper and lower jaw margins which results in a relatively thin central web 25 for each jaw 10,17,18. Extending along one side of each groove 24 is an inwardly projecting ridge 26, and extending along the opposite side of each groove 24 is a shoulder 27 that is co-planar with the inner edge of the ridge 26. From each shoulder 27 there protrudes an inward lip 28 that completes the contouring of the gripping faces 12,22,23.

Figure 4:
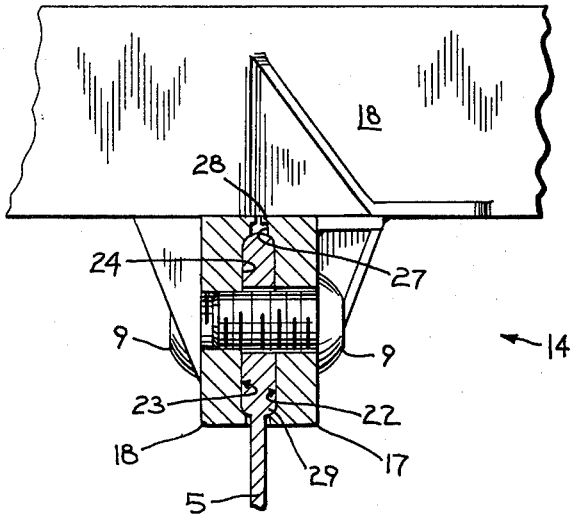
FIG. 4 is a fragmentary view in section taken through the plane of the line 4—4 indicated in FIG. 1.

The ridges 26 and the shoulders 27 with lips 28 present a channel-like appearance for each clamping jaw 10, 17, and 18, and when the parts are assembled the gripping faces 12,22,23 are adapted to receive and clamp around the edge margins of a variety of different street sign shapes. FIG. 4 demonstrates how the gripping faces 22,23 of the upper sign holder 14 may receive and securely hold a street sign having thickened edge margins 29, such as shown for the signs 5 and 15. The grooves 24 are contoured to match the shape of the thickened edge margins 29, so that the upper sign holder 14 will sit at the correct height on the lower sign 5 and clamp tightly against and around the side surfaces of the thickened sign margin. Similarly, the upper sign 15 is held in its proper position in the vise-like grip of the upper clamping jaws 17,18. Not only are the signs tightly held, but they cannot be removed by any attempt to slide them from between the clamping jaws 17,18 because of the bolts 9 passing through the signs. Any attempt to move the signs 5,15 vertically from the sign holder 14 is blocked by the sidewise protrusion of the ridges 26 and the shoulders 27.

Figure 5:
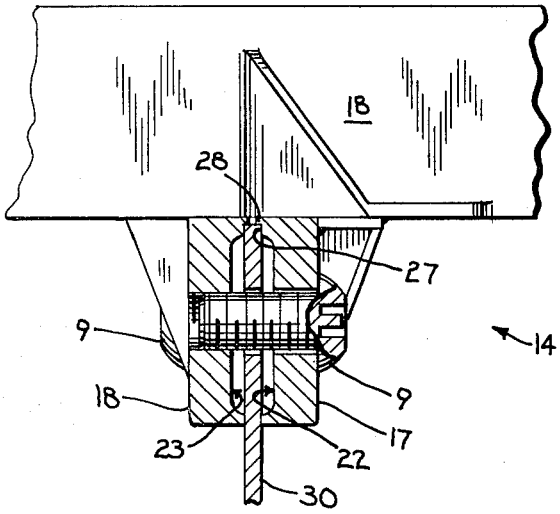
FIG. 5 is a fragmentary view in section similar to that of FIG. 4 illustrating the clamping of an alternative form of a street sign.
Figure 6:
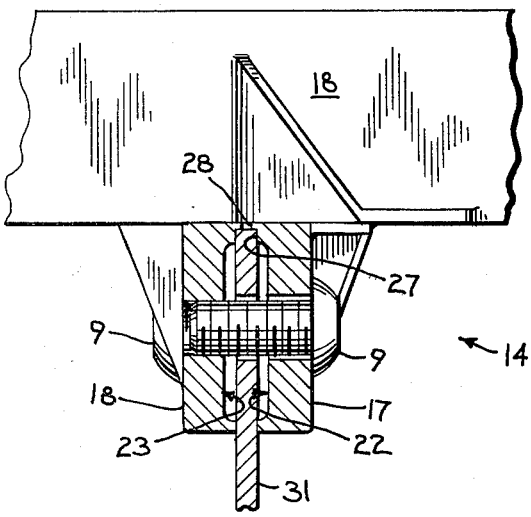
FIG. 6 is a detailed view in section similar to FIGS. 4 and 5 illustrating the clamping of a street sign of wider thickness than that in FIG. 5.

FIGS. 5 and 6 show the manner of attachment of the upper sign holder 14 with signs 30 and 31 that are of uniform thickness throughout their entire surface. In the instance of such signs, the outer edge of a sign holder 30 or 31 is abutted against the shoulders 27 and lips 28 of the associated gripping faces 22,23. This locates the sign 30 or 31 with respect to the sign holder 14, and the projecting ridges 26 clamp tightly against the sign surface to resist disclocation of the parts. The signs 30 and 31 of FIGS. 5 and 6 are similar to one another, except for a difference in thickness. It is to be understood that the clamping jaws 10 of the cap 2 mate with sign edge margins in similar fashion as that described with respect to the sign holder 14. The cap 2, however, does not pass assembly bolts 9 through the associated sign edge margin, but instead employs the pins 13 projecting from the gripping faces 12 to interlock the sign 5 in place.

The assembly of the two clamp members 16 making up the upper sign holder 14 is accomplished by moving them toward one another on a path oblique to the longitudinal directions of the individual clamping jaws 17,18. In FIG. 3, for example, the clamp members 16 would be moved vertically of the drawing so that the upper clamping jaw 17 of one clamp member 16 can move into a congruent juxtaposition with respect to the upper clamping jaw 18 of the other clamp member 16, while at the same time the two lower jaws 17,18 are similarly brought into position. As this motion is made the signs 5,15 are positioned in place, and then the bolts 9 are inserted and brought up tight. To have the signs 5,15 intersect one another at their centers, each clamp member 16 has its jaws 17,18 slightly off center of one another. Then, when the jaws are assembled the sign receiving space between two facing jaws 17,18 is at the center of the crosswise jaws 17,18.

FIGS. 7–9 show an alternate construction for an upper sign holder 32 that constitues a second embodiment of the invention. The same cap 2, as previously described herein, is used in conjunction with the second embodiment. The upper sign holder 32 of FIGS. 7–9, includes a pair of identical clamp members 33 that each have a centrally located semi-circular hub 34 disposed between a pair of clamping jaws 35,36. The two clamp members 33 are oriented top to bottom and at 90° with respect to one another, similarly as for the sign holder 14 of the first embodiment to have complementary parts that match one another. Thus, the jaw 35 of one clamp member 33 is shown integrally cast to the top of the hub 34 and the jaw 36 for such member 33 is integrally cast to the bottom of its hub 34. For the other clamp member 33 the jaws 35,36 are in reverse position, with the jaw 35 integral with the bottom of its hub 34 and the jaw 36 integral with the top of the hub 34. The four clamping jaws 35,36 present gripping faces 37 on each of them that are of the same configuration as the faces 12,22,23 in the first embodiment. Also, the jaws 35 and 36 of a clamp member 33 are disposed crosswise to each other in a 90° relationship, although this angular relationship may be varied. The jaws 35,36 also have pins 38 projecting from the gripping faces 37 that protrude into complementary sign openings for preventing signs from sliding out from between the clamping jaws 35,36.

The hubs 34 have opposing diametrically extending surfaces 39 that each have a threaded bolt-receiving bore 40 formed therein at one end. Each hub 34 further has a notch 41 formed along the circumference of its other end. Each notch 41 has an opening 43 that extends to the surfaces 39 to loosely receive the shaft of a fastening bolt 44. Thus, when the two clamp members 33 are placed in facing relation to one another, as shown in FIGS. 7–9, the bore 40 of one hub 34 is aligned with the opening 43 of the other hub 34. The bolts 44 may then be inserted through the openings 43 and engaged in the bore 40 so that they may be brought up tightly to firmly secure the upper sign holder 32 to an upper and lower sign.

The assembly of the two clamp members 33 of the upper sign holder 32 is similar to that of the clamp members 16. The clamp members 33 are moved toward one another on a path oblique to the longitudinal directions of the individual clamping jaws 35,36. This moves the clamping jaws 35,36 into a congruent juxtaposition with respect to one another while at the same time, the opposing surfaces 39 of the hubs 34 are brought in a face-to-face relation with one another. As this motion is made, the signs are positioned in place between the clamping jaws 35,36 and then the fastening bolts 44 are inserted and brought up tight. In the same manner as the clamp members 16, the clamping jaws 35,36 of the clamp members 33 are cast with the hubs 34 slightly off center of one another so that when assembled the jaws 35,36 hold the signs in the center of the upper sign holder 32.

Figure 10:
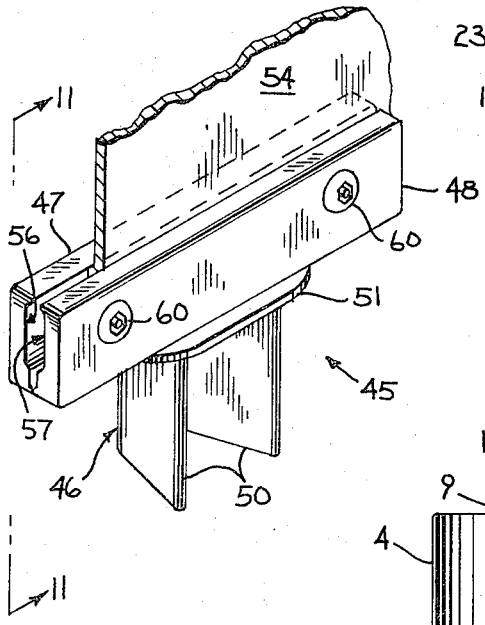
FIG. 10 is a fragmentary view in perspective, partly in section, illustrating an alternate cap constituting a third embodiment of the invention.
Figure 11:
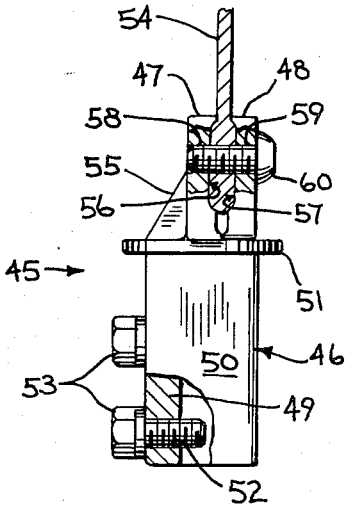
FIG. 11 is a fragmentary end view with parts cut away taken through the plane of the line 11—11 indicated in FIG. 10.

FIGS. 10 and 11 show an alternate construction for a cap structure 45 that constitutes a third embodiment of the invention. Either of the upper sign holders 14, 32, as previously described herein, may be used in conjunction with the third embodiment. The cap structure 45 of FIGS. 10 and 11, includes a base or body portion 46 and a pair of clamping jaws 47, 48. The body portion 46 is generally in the shape of a truncated V, and includes a vertical base plate 49 having a pair of side flanges 50 that diverge from its opposite edges, and a mounting plate 51 disposed on top of the base plate 49 and flanges 50. The body portion 46 is preferably cast as one piece to develop a unitary structure. The base plate 49 further includes a pair of vertically aligned threaded openings, one of which is shown at 52, for engagement with a pair of fastening bolts 53.

The body portion 46 of the cap 45 also includes as an integral part thereof an elongate rail-shaped clamping jaw 47 that is one of a pair of jaws 47, 48 for mounting and supporting a sign 54. The clamping jaw 47 is integrally cast on the mounting plate 51, and rises vertically therefrom above the top of the body portion 46 of the cap 45. The clamping jaw 47 overhangs beyond the body portion 46 to receive the edge margin of the sign 54 at a position medial of the sign length. A pair of triangular shaped braces 55 on the top of the mounting plate 51 reinforce the jaw 47 and lend added strength to the structure. These braces 55 are also cast along with the clamping jaw 47 and body portion 46 to develop a unitary, rigid structure.

The clamping jaw 48 is similar to the clamping jaw 47, exept that it is not integrally cast with the body portion 46. The clamping jaw 48 opposes the clamping jaw 47, and may be brought into close juxtaposition therewith to receive and hold the sign 54. The clamping jaws 47,48 are formed with like, inwardly directed gripping faces 56,57 that mate with the contours of the edge margin of the sign 54. These faces 56,57 are of the same configuration as the faces 12,22,23,37 in the first and second embodiments previously described herein.

The clamping jaw 47 has a pair of threaded openings 58 at its opposite ends, and the clamping jaw 48 has a pair of openings 59 at its opposite ends to loosely receive the shaft of additional fastening bolts 60. When the two jaws 47,48 are brought into close juxtaposition as shown in FIGS. 10 and 11, each opening 59 becomes aligned with a threaded opening 58. The fastening bolts 60 can then each pass through the openings 59 and complementary openings in the sign 54 for threaded reception in the openings 58. The bolts 60 may then be brought up tightly so as to have the clamping jaws 47,48 clamp upon the edge margin of the sign 54.

Problems involving vandalism of street signs have resulted in the need for tamper-proof support structures. To solve this problem, the fastening bolts 9,44,53,60 used for assembling and tightening the caps 2,45 and the upper sign holders 14,32 of the invention are preverably tamper-free bolts which require special allen head type wrenches to tighten and loosen them from position. As best seen in FIGS. 3 and 5, the heads of the bolts 9 used in the assembly have a hexagonal bore surrounding a small, centrally located pin. Correspondingly, the allen wrench used must have a bore formed at its ends to receive this pin. Although such tamper-free bolts are preferred, other types of tamper-free fasteners may be employed.

In order to mount and support street signs on the post 3, the cap sectors 4 are positioned around the top of the post 3 with the bottom edge margin of the lower sign 5 disposed between the gripping faces 12 of the clamping jaws 10. As the fastening bolts 9 are inserted into the lugs 7 and 8 and tightened, the cap sectors 4 and clamping jaws 10 are tightly fastened at the same time to the post 3 and lower sign 5. The upper sign 15 is then mounted by first positioning the lower edge margin of the upper sign 15 between the gripping faces 22 of the clamping jaws 17 of the clamp members 16, and aligning the openings in the upper sign 15 with the slots 20 and threaded openings 21 of the jaws 17. Then the gripping faces 23 of the clamping jaws 10 are positioned around the top edge margin of the lower sign 5 and the openings in that sign 5 are aligned with the slots 20 and threaded openings 21 in the jaws 18. When the fastening bolts 9 are inserted into these aligned openings and tightened, the clamp members 16 are tightly secured at the same time to the top edge margin of the lower sign 5 and the lower edge margin of the upper sign 15. In the second embodiment of the invention, the tightening of the fastening bolts 44 in the hubs 34 result in the upper and lower clamping jaws 35,36 of the clamp members 33 being tightly secured at the same time to the top edge margin of the lower sign and to the lower edge margin of the upper sign. In the third embodiment of the invention, the assembly of the cap structure 45 is accomplished by first inserting the base plate 49 and flanges 50 of the body portion 46 within the top portion of a corresponding V-shaped mounting pole. The threaded openings 52 in the base plate 49 are then aligned with a corresponding pair of openings formed in the top of the pole, and the fastening bolts 53 are passed through these openings for threaded engagement in the openings 52 of the base plate 49. The bolts 53 are brought up tightly so as to secure the cap 45 to the pole. The edge of the sign 54 is then positioned between the gripping faces 56,57 of the clamping jaws 47,48, and the openings 58,59 in the jaws 47,48 are aligned with corresponding openings in the sign 54. The fastening bolts 60 are then inserted through these openings and brought up tightly to firmly secure the sign 54 in place.

The preferred embodiments of the invention shown and described herein provide a sturdy sign support structure that cannot easily be destroyed or damaged. The sign assembly described herein is preferably for use with street signs that identify conventional 90° street intersections. However, as previously noted, the assembly may be used with street intersections at other than 90°, and furthermore, may be used to mount signs other than elongate street identification signs. Additionally, the invention may be used to mount any number of signs above each other, and is not limited to a cap and upper sign holder having merely two members. Any number of complementary cap sectors and clamp members may be used without departure from the spirit of the invention. Further, the support structure disclosed herein may accommodate signs having different edge margin configurations which eliminates the need for having separate support structures for each kind of sign.

I claim:

1. A support structure for mounting signs on top of a post, comprising:

first and second signs;

a cap having a base adapted to be fastened to the top of the post;

clamping means associated with said base having a pair of opposing sign gripping faces movable toward one another for receiving and holding a lower margin of said first sign; and an upper sign holder having a pair of complementary clamp members each having a first clamping jaw disposed crosswise to a second clamping jaw, said clamp members being disposed in reversed positions with respect to one another to have each jaw of each clamp member facing a jaw of the other clamp member, and said clamp members movable toward one another with a first set of jaws receiving and holding the upper margin of said first sign and a second set of jaws receiving and holding a lower margin of said second sign crosswise to the first sign.

2. The support structure of claim 1, wherein:

said base includes complementary semi-cylindrical cap sectors having integrally formed ear-like lugs that project radially outward from opposite ends of each cap sector to oppose lugs on the other cap sector when said cap sectors surround said post to thereby receive fasteners that extend through opposing pairs of lugs to secure said cap sectors to said post.

3. A support structure for mounting signs on top of a post, comprising:

first and second signs;

a two-piece cap having complementary semi-cylindrical cap sectors adapted to be fastened around the top of the post;

a pair of sector clamping jaws extending vertically upward from said cap sectors, each of said jaws presenting a sign gripping face along one side thereof, said jaws movable toward one another for receiving and holding said first sign; and a two-story upper sign holder having complementary clamp members each having a first clamping jaw disposed crosswise to a second clamping jaw, said clamp members being in reversed position with respect to one another and movable toward one another on a path oblique to the clamping jaws with the first jaws receiving and holding an edge margin of said first sign and the second jaws receiving and holding an edge margin of said second sign in a position crosswise to the first sign.

4. The support structure of claim 3, wherein:

said sign gripping faces have an inwardly projecting longitudinal ridge along one edge and a longitudinal shoulder along the other edge that receive and orient an edge margin of a sign.

5. The support structure of claim 4, wherein:

said ridges and shoulders are co-planar; and said gripping faces further include a longitudinally recessed groove between said ridges and shoulders.

6. The support structure of claim 3, wherein:

said sign gripping faces have pins projecting inwardly therefrom that enter a sign gripped thereby.

7. The support structure of claim 3, wherein said clamp members further include:

a semi-circular hub disposed centrally between said first and second clamping jaws, said hub having a diametrically extending surface that opposes a diametrically extending surface of a like hub when said clamp members are fastened in close juxtaposition with one another.

8. A clamp member for mounting signs comprising:

a first elongate clamping jaw having a sign gripping face along one side thereof for receiving and holding the edge margin of a sign and a second elongate clamping jaw secured in crosswise direction to said first jaw to form a unitary clamp member therewith, and also having a sign gripping face along one side thereof, said sign gripping faces have an inwardly projecting longitudinal shoulder along one edge and a longitudinal ridge along the other edge; and said unitary clamping member being movable toward a like second unitary clamp member that is reversed in position with respect thereto, with the sign gripping face of said first jaw closely spaced in opposing relation with a sign gripping face of a clamping jaw of such second unitary jaw closely spaced in opposing relation with a sign gripping face of the other clamping jaw of such unitary clamp member.

9. A clamp member as in claim 8 having openings in each clamping jaw that oppose openings in a like second unitary clamp member when in juxtaposition therewith, to thereby receive fasteners that extend through opposing clamping jaws and a sign gripped therebetween.

10. A clamp member as in claim 8 having protrusions from said sign gripping faces to enter a sign gripped thereby.

11. A cap structure for mounting a sign on top of a post, comprising:

a base member adapted to be fastened to the post;

a first elongate clamping jaw integral with said base member that extends vertically upward above said base member having a sign gripping face along one side thereof for receiving and holding an edge margin of the sign;

a second elongate clamping jaw also having a sign gripping face along one side thereof, said second jaw being movable toward said first jaw with the sign gripping face of said first jaw closely spaced in opposing relation with the sign gripping face of said second jaw, each of said sign gripping faces have an inwardly projecting longitudinal shoulder along one edge and a longitudinal ridge along the other edge to grip the sign therebetween; and assembly means for securing said first and second jaws together.

12. A cap structure for mounting a sign on top of a post, comprising:

a generally V-shaped member adapted to be fastened to the post;

a first elongate clamping jaw integral with said base member that extends vertically upward above said base member having a sign gripping face along one side thereof for receiving and holding an edge margin of the sign;

a second elongate clamping jaw also having a sign gripping face along one side thereof, each of said sign gripping faces have an inwardly projecting longitudinal shoulder along one edge and a longitudinal ridge along the other edge, said second jaw being movable toward said first jaw with the sign gripping face of said first jaw closely spaced in opposing relation with the sign gripping face of said second jaw to grip the sign medially of its length therebetween; and assembly means for securing said first and second jaws together, and for projecting into the sign held between said sign gripping faces.

13. A cap structure for mounting a sign on top of a post, comprising:

a base member including complementary cap sectors adpated to surround the top of the post;

elongate clamping jaws integral with said cap sectors that extend vertically upward above said cap sectors, each of said clamping jaws presenting sign gripping faces movable toward one another for receiving and holding an edge margin of the sign therebetween, said sign gripping faces have an inwardly projecting longitudinal shoulder along one edge and a longitudinal ridge along the other edge; and ear-like lugs projecting radially outward from opposite ends of a cap sector, said lugs oppose lugs in a like cap sector when said cap sectors surround the post to receive fasteners that extend through opposing pairs of lugs to secure said cap sectors and said clamping jaws together.

14. In a sign holder the combination of:

a first clamp member having a first elongate clamping jaw with a sign gripping face along one side thereof, and a second elongate clamping jaw disposed above, secured to and crossing over said first clamping jaw at an angle thereto with a second sign gripping face along one side thereof;

a second clamp member separable from said first clamp member having a third elongate clamping jaw with a sign gripping face along one side thereof in facing relation to the said face of said first clamping jaw, and a fourth elongate clamping jaw disposed above, secured to and crossing over said third clamping jaw with a sign gripping face along one side thereof in facing relation to said face of said second clamping jaw;

said clamp members being movable toward one another in a movement oblique to said gripping faces to grasp signs therebetween; and means for securing said clamp members and signs therebetween in tightly assembled relation.

* * * * *

UNITED STATES PATENT AND TRADEMARK OFFICE

CERTIFICATE OF CORRECTION

PATENT NO. : 4,262,438

DATED : April 21, 1981

INVENTOR(S) : John J. Scherer

It is certified that error appears in the above—identified patent and that said Letters Patent is hereby corrected as shown below:

Column 2, line 53, "provde" should read --provide---

Column 5, line 47, "disclocation" should read --dislocation--

Column 7, line 28, "exept" should read --except--

Column 9, line 30, "story" should read --piece--

Column 10, line 8, after "unitary" insert --clamp member and the sign gripping face of said second--

Column 10, line 64, "adpated" should read --adapted--

Signed and Sealed this

Thirtieth Day of June 1981

[SEAL]

Attest:

RENE D. TEGTMEYER

Attesting Officer

Acting Commissioner of Patents and Trademarks